United States Patent [19]

Potter et al.

[11] 4,145,777

[45] Mar. 27, 1979

[54] BED FRAME

[75] Inventors: Duane W. Potter; Joseph R. Thompson, both of Winchester, Ky.

[73] Assignee: Leggett & Platt, Incorporated, Carthage, Mo.

[21] Appl. No.: 787,953

[22] Filed: Apr. 15, 1977

[51] Int. Cl.[2] ..... A47C 19/12

[52] U.S. Cl. ..... 5/176 R; 5/201; 5/282 R; 29/446

[58] Field of Search ..... 5/176 R, 184, 202, 286, 5/176 B, 201, 282 R, 116, 305; 29/446

[56] References Cited

U.S. PATENT DOCUMENTS

| | | | |
|---|---|---|---|
| 1,038,593 | 9/1912 | Jones | 5/201 |
| 1,093,774 | 4/1914 | Fagan | 5/176 R |
| 1,795,060 | 3/1931 | Vance | 5/184 |
| 3,761,970 | 10/1973 | Fredman | 5/176 R |

*Primary Examiner*—Mervin Stein
*Assistant Examiner*—Alex Grosz
*Attorney, Agent, or Firm*—Wood, Herron & Evans

[57] ABSTRACT

An improved bed frame structure that includes initially separate headboard and footboard members, the legs of the headboard and footboard being connected by initially separate side rails. In the preferred embodiment, two tension rods are connected in an X-pattern between the side rails. The tension rods are sized, relative to their connection points with the side rails, so that the rods are maintained under tension, i.e., so that the side rails are slightly bowed inwardly when the frame is erected, thereby locking the headboard footboard and side rails into a tight bed frame configuration.

11 Claims, 5 Drawing Figures

BED FRAME

This invention relates to an improved bed frame structure.

Bed frames are, of course, very well known to the art. One type of bed frame basically includes a headboard and a footboard, the headboard and footboard being connected on opposed sides by side rails. In other words, the bed frame is basically comprised of four initially separate parts, namely, a headboard, a footboard, and two side rails. These four bed frame parts are assembled at the use location of the bed into the rectangular bed frame configuration. Of course, the bed frame, after being erected, is used to support a mattress foundation and mattress as is very well known to the prior art.

A bed frame of the type described above may be erected by connecting the first side rail to one leg of the headboard, and connecting the second side rail to the other leg of the headboard. The side rails are then connected to the corresponding bed side legs of the footboard. Various connector devices are known to the prior art by which the side rails may be connected with the legs of the headboard and footboard. However, one problem with some known connector devices is that those devices do not maintain the bed frame in the classic rectangular bed frame configuration after the bed frame is fully erected. In other words, the connector devices may permit the footboard to move laterally relative to the headboard, i.e., become laterally misaligned relative to the headboard, after the bed frame is erected. This problem may occur during use and, particularly, when it is attempted to move the bed by pushing only on the footboard or headboard thereof. The sway or wobble introduced into the bed frame is so introduced because the frame is, in effect, not locked tight into the desired rectangular frame configuration.

It has been one objective of this invention to provide an improved bed frame of the type having initially separate headboard, footboard and opposed side rails, that bed frame incorporating lock up means that cooperates with the bed frame's side rails so as to prevent substantial lateral motion of the footboard relative to the headboard, i.e., to prevent sway of the bed frame, after the bed frame has been erected.

It has been another objective of this invention to provide an improved bed frame of the type having initially separarate headboard, footboard, and side rails, the bed frame incorporating lock up means in the form of tension rods that interconnect the side rails, those tension rods being maintained in tension between those side rails after the bed frame is erected, thereby locking the bed frame into a tight frame configuration.

It has been a further objective of this invention to provide an improved bed frame as set forth in the above two paragraphs in which the lock up means is in the form of tension rods adapted to interconnect the bed frame's opposed side rails, the structure by which those tension rods interconnect the side rails being adjustable to permit use of the same side rails with at least two different width bed frames.

In accord with the objectives of this invention, the improved bed frame structure includes initially separate headboard and footboard members, the legs of the headboard and footboard being connected by initially separate side rails. In the preferred embodiment, two tension rods are connected in an X-pattern between the side rails. The tension rods are sized, relative to their connection points with the side rails, so that the rods are maintained under tension, i.e., so that the side rails are slightly bowed inwardly when the frame is erected, thereby locking the headboard, footboard and side rails into a tight bed frame configuration.

Other objectives and advantages of this invention will be more apparent from the following detailed description taken in conjunction with the drawings in which.

Figure 1:
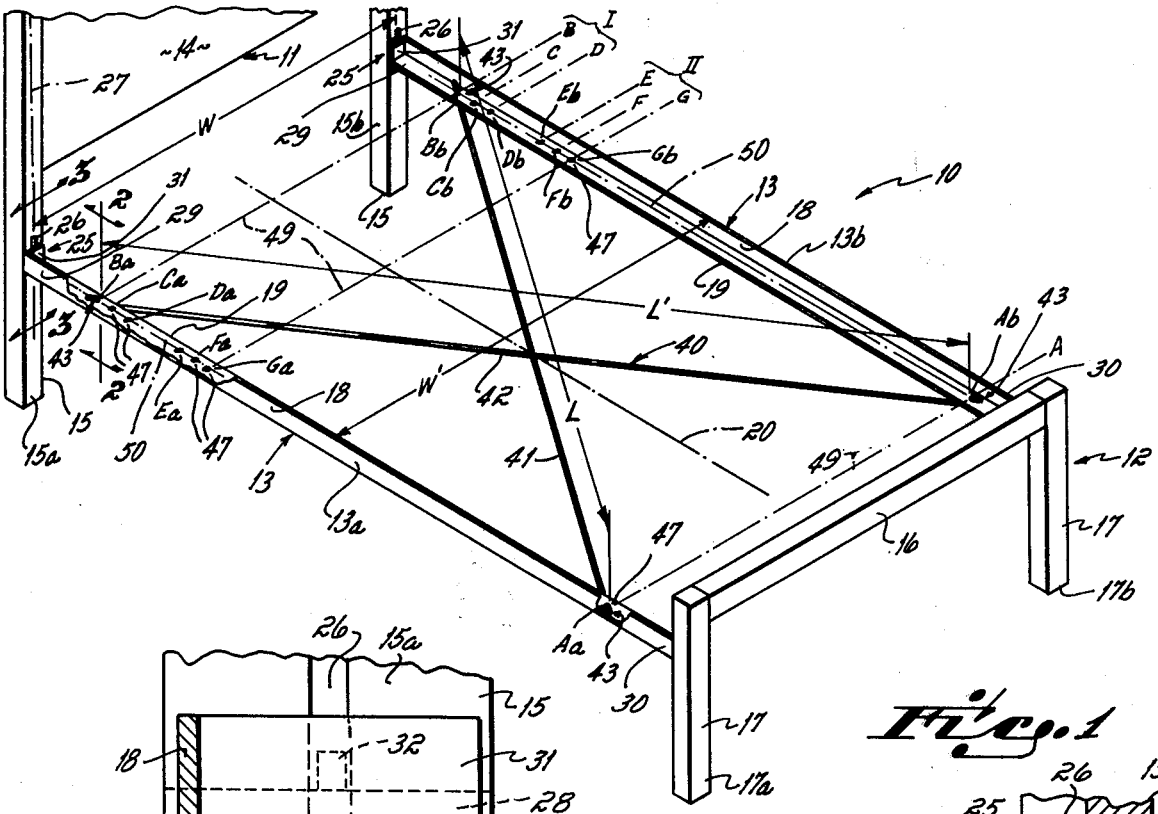
FIG. 1 is a perspective view illustrating a preferred embodiment of an improved bed frame incorporating lock up means in accord with the principles of this invention.

A bed frame 10 in accord with the principles of this invention is illustrated in FIG. 1. As shown in that Figure, the bed frame includes a headboard 11, a footboard 12, and opposed left and right side rails 13*a*, 13*b*. The headboard 11 is of a unitary structure comprising the center board 14 and side legs 15*a*, 15*b*, those legs being fixed to and integral with the center board. The footboard 12 is illustrated as comprising a crossbar 16 connecting side legs 17*a*, 17*b*, those legs being fixed to and integral with the crossbar. Each of the side rails 13 is of a right angular structure in cross-sectional configuration, those right angle rails being oriented with the vertical web 18 of each extending upwardly above the horizontal web 19 of each, and with the horizontal webs 19 of the opposed rails being directed inwardly toward the longitudinal axis 20 of the bed frame.

Figure 2:
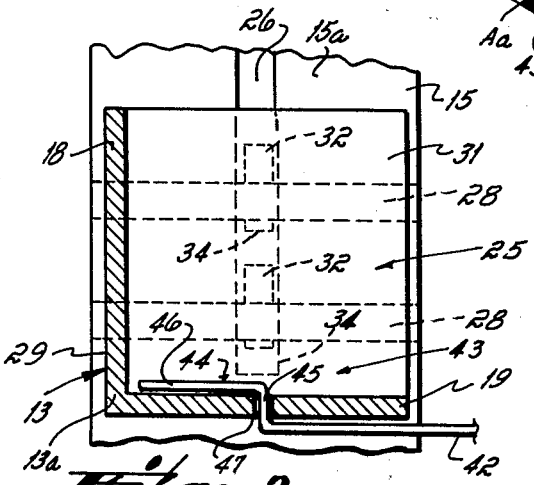
FIG. 2 is a cross-sectional view taken along line 2—2 of FIG. 1.
Figure 3:
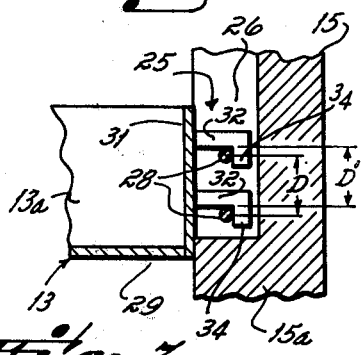
FIG. 3 is a cross-sectional view taken along line 3—3 of FIG. 1.

The left and right side rails 13 are adapted to be interconnected with the legs 15, 17 of the headboard 11 and footboard 12, respectively, by quick connect/disconnect type connectors 25. The connector 25 structure is the same at all four corners of the bed frame, and at each corner is partially carried by the headboard 11 or footboard 12 and partially carried by a side rail 13. More particularly as to the connector 25 structure, each leg 15 of the headboard 11, as illustrated in FIGS. 2 and 3, is provided with a slot 26 which runs longitudinally relative to the axis 27 of that leg. Two leg pins 28 are provided in each leg in parallel relation one with the other, the leg pins being spaced a centerline distance D from one another and being oriented normal to the longitudinal slot 26 in the leg. The leg pins 28 in each leg 15 extend through the slot 26 from side face to side face of the leg. The legs 17 of footboard 12 are identically structured. Each end 29, 30 of each side rail 13 is provided with an end plate 31, see FIG. 3. Latch fingers 32 are mounted to the exterior face of each end plate 31 and are oriented to extend outwardly therefrom in generally longitudinal fashion relative to the longitudinal axis 33 of the side rail 13. The latch fingers 32 are vertically spaced one from another on the end plate a centerline distance D′ equal to the vertical distance D which the leg pins 28 are spaced from one another in the corresponding leg 15 or 17. Each of the latch fingers 32 includes a downwardly extending thumb portion 34 adapted to overlie or entrap a leg pin 28 in the juxtaposed leg 15 or 17 when the side rails 13, and headboard 11 and footboard 12 are connected in bed frame configuration as shown in FIG. 3. In assembly of the side rails 13 with the headboard 11 and footboard 12, each side rail end 29 or 30 is simply oriented relative to the leg 15 or 17 with which it is to be connected so that the latch fingers 32 can be inserted into slot 26 in that adjacent leg, and thereafter dropped down over the leg pins 28 in that leg, thereby interconnecting the side rail with that leg. This, of course, provides a quick connect/disconnect type connector 25 structure in that only a simple manual insert step is required, i.e., no bolts and nuts or the like are required.

Figure 4:
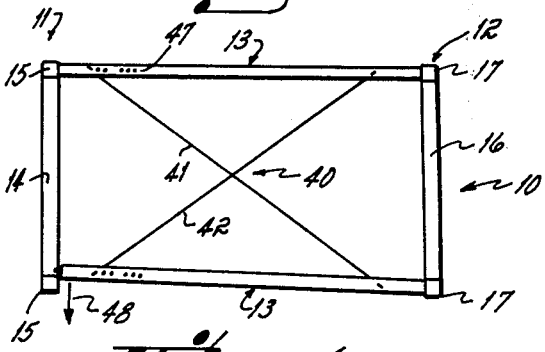
FIG. 4 is a top plan view illustrating an intermediate step in the set up or erection of a bed frame in accord with the principles of this invention.
Figure 5:
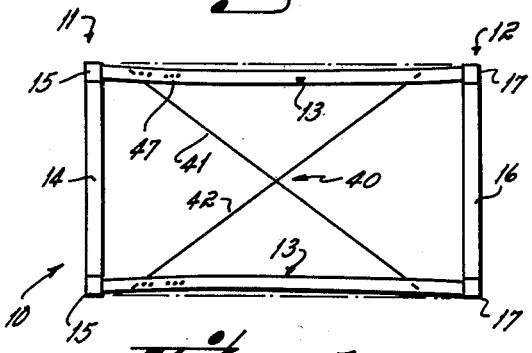
FIG. 5 is a top plan view similar to FIG. 4 but illustrating the bed frame in the fully erected attitude.

The lock up means 40 for the improved bed frame 10 is comprised of the two tension rods 41, 42 as illustrated in FIGS. 1, 4 and 5, those tension rods being of equal length. As shown in those Figures, each of the tension rods 41, 42 is connected with a side rail 13*a* and 13*b*, respectively, at one end of the bed frame 10 (the footboard 12 end as shown in FIG. 1) at a single fixed location denoted A. The tension rods 41, 42 are oriented in a cross or X-pattern, and each is connected with an opposed side rail 13*b* and 13*a*, respectively, at the other end of the bed frame 10 (the headboard 11 end as shown in FIG. 1) at one of multiple fixed locations denoted B–G.

The connection of each end of each tension rod 41, 42 with a side rail 13 is established by a fastener structure 43 partially carried by the rod and partially carried by the side rail, see FIG. 2. The portion of fastener structure 43 at each end of each tension rod 41, 42 is in the form of a dog leg 44 that includes a perpendicular leg section 45, and a parallel foot section 46, relative to the linear tension rod. The portion of fastener structure 43 in each side rail 13 is in the form of a hole 47 in the horizontal web 19 thereof. The tension rods 41, 42 are thereby connected with the side rails 13 by trapping the rods' dog legs 44 in the side rails' holes 47. Note the tension rods 41, 42 are connected with the opposed side rails 13 so that the rods are oriented below the side rails' horizontal webs 19, each dog leg's foot section 46 overlying the top face of the related side rails' horizontal web, all as illustrated in FIG. 2.

Note particularly that the headboard 11 end of each tension rod 41, 42 is provided with multiple connection points, i.e., connect locations B–G, on the headboard end 29 of each side rail 13. As previously mentioned, the footboard 12 end of each tension rod 41, 42 is provided with only one connection point, i.e., connection location A, on the footboard end 30 of each side rail 13, as shown in FIG. 1. The multiple connect locations B–G on each side rail's head board end 29 are divided into two groups, namely group I and group II. The connect holes or locations B–D of group I are for use when the side rails 13 and tension rods 41, 42 are used with a headboard 11 and footboard 12 of a single bed width. The connect holes or locations E–G of group II are for use when the side rails 13 and tension rods 41, 42 are used with the headboard and footboard (not shown) of double bed width. In other words, and when the headboard 11 and footboard 12 are of single bed width the headboard end of each tension rod 41, 42 is connected with a cross rail 13 in that hole 47 of group I which serves that single bed width, and when the headboard and footboard (not shown) are of double bed width the headboard end of each tension rod 41, 42 is connected with a side rail 13 in that hole 47 of group II which serves that double bed width. Note each pair of holes Aa, Ab and Ba, Bb and Ca, Cb and so forth in the opposed side rails 13*a*, 13*b* is disposed on a phantom line 49 perpendicular to the bed frame's longitudinal axis 20, those lines 49 being parallel one to the other. Further, the holes B–G in each side rail 13 are all disposed on a common phantom line 50, that phantom line being parallel to the longitudinal axis 33 of that side rail when that side rail is not in the frame erected attitude.

Note particularly that within that group I of holes 47 for a single bed width, and within that group II of holes 47 for a double bed width, there are three holes B–D and E–G, respectively. As a practical matter, and throughout the United States, a single bed frame sold in one geographic area may have a different width than that of a single bed frame sold in a different area. The widths of a single bed frame may vary up to a couple of inches or more between such areas. The same is the case with double bed frames. In other words, and with reference to the headboard 11 and footboard 12, the width W between slots 26 in those boards' legs 15, 17 (which width, for purposes of this application, is referred to as the bed width) may vary from area to area throughout the country. In other words, and for purposes of this application, bed width W shall mean the width W between the side rail connector 25 structure, i.e., slots 26, on either headboard 11 or footboard 12. It is the variance in this bed width W that is accommodated by the multiple holes B–D in the single bed width group I, and by the multiple holes E–G in the double bed width group II, on each of the opposed side rails. As the headboard end of each tension rod 41, 42 is connected with the holes B–G on the side rails 13*a*, 13*b* in that B–G sequence, the width W′ or space between those side rails increases. In other words, and as the headboard end of the tension rods' connection B–G with the side rails 13 proceeds from the side rails' headboard ends 29 toward the side rails' footboard ends 30 on each side rail, the width W′ or space between the side rails increases when the side rails 13*a*, 13*b* are aligned in parallel fashion and when the side rails end plates 31 at the footboard end 30 are in a common plane transverse to those side rails. Conversely, and as the connections of the headboard ends of the tension rods 41, 42 with the side rails 13 approach or move toward the side rails' headboard ends 29 from the side rails' footboard ends, from holes G–B in that G–B sequence, the width W′ or space between the side rails decreases. In this manner the correct position of the tension rods 41, 42 can be located relative to the known bed width of the headboard 11 and footboard 12 so as to maintain the tension rods in tension after the bed frame 10 is erected. In other words, the length L and L′ between connection points between points Aa and Gb for tension rod 41 and points Ab and Ba for tension rod 42, for example and as shown for the rods 41, 42, can be regulated relative to the length of each tension rod 41, 42 so each tension rod is placed and maintained in tension during and after erection of the bed frame 10. The tension of rods 41, 42, after the bed frame 10 is erected, interacts with the headboard 11, footboard 12 and side rails 13 to lock up the bed frame into a tight bed frame configuration.

In assembly of the bed frame 10 of this invention, and in use thereof, the tension rods 41, 42 are, of course, first connected in holes A of the side rails 13*a*, 13*b* at the footboard ends 30 of those side rails. As to the relationship of holes B–D to the bed width W, and for example, when the tension rods 41, 42 are connected at holes A with the side rails 13, when the side rails 13 are parallel and when the tension rods' headboard ends are also connected in the side rails' holes B, the free standing bed width W' of disconnected side rails 13 may be 37½ inches, and when connected with holes C the free standing bed width of disconnected bed rails 13 may be 38⅜ inches. As used herein, the phrase disconnected side rails 13 refers to those rails connected by rods 41, 42, but not connected to headboard 11 or footboard 12. Also as used herein, free standing bed width shall mean the width (no reference letter or number provided) between side rail connector 25 structure, i.e., latch fingers 32, at the same ends of left 13*a* and right 13*b* side rails when those side rails are parallel, when those side rails' end plates 31 are in a common plane transverse to those side rails, and when those side rails are connected to tension rods 41, 42 but unconnected to headboard 11 and footboard 12. The bed width W of the headboard 11 is then determined by measuring the centerline distance W between the slots 26 in the legs 15 of that headboard. For example, if the headboard 11 and footboard 12 are of a single bed width as shown, the distance W between those slots may be 38 inches. This being the case, the headboard end of each tension rod 41, 42 is connected in hole B. In other words, the headboard end of the tension rods 41, 42 is connected in that hole B–D which would provide a free standing bed width between the disconnected side rails 13 that is just slightly less than the bed width W between slots 26 in the headboard 11. It is important that the hole B–D selected in the single bed group I be that hole which provides a free standing bed width between disconnected rails 13 less than the width W; this being the case, the tension rods 41, 42 will be in tension when the frame 10 is fully erected. In other words, it is inappropriate and not useful to connect the headboard end of the tension rods 41, 42 with any of those holes which would provide the side rails 13 with a free standing bed width greater than the bed width W.

With the footboard ends of the tension rods 41, 42 connected in holes A of opposed side rails 13, and with the headboard ends of those tension rods connected in holes B of those side rails, one of the side rails 13*b* is connected at one end 29 with headboard's leg 15*b* and at the other end 30 with footboard's leg 17*b* by the connect/disconnect type connectors 25. The footboard end 30 of the other side rail 13*a* is also connected with the other footboard leg 17*a* with connector 25, thereby providing an intermediate installation attitude illustrated in FIG. 4.

As shown in this intermediate installation attitude of FIG. 4, the headboard end 29 of the other cross rail 13*a* must be thereafter pulled outwardly relative to the longitudinal axis 20 of the bed frame 10 in a direction illustrated by arrow 48. With the headboard end 29 of the other cross rail 13*a* so pulled outwardly, the other headborad leg 15*a* can be connected therewith by a quick connect/disconnect connector 25 to establish the final bed frame 10 configuration, see FIG. 5. As shown in that FIG. 5, and because of the interconnection of the tension rods 41, 42 with the opposed side rails 13 in the X-pattern as viewed in top plan view, the side rails are bowed slightly inwardly relative to the ends 20, 30 thereof and relative to the longitudinal axis 20 of the bed frame, compare the solid line attitude of those side rails shown in FIG. 5 to the phantom line attitude shown in FIG. 5. The phantom line attitude of the opposed side rails 13 shown in FIG. 5 would be that attitude taken by the opposed side rails 13 if there were no tension rods 41, 42 which interconnected same. With the bed frame erected as illustrated in FIG. 5, the tension rods 41, 42 are maintained in tension at all times, thereby locking up or firming up the rectangular bed frame configuration. This locking up of the bed frame prevents the footboard 12 from moving relative to the headboard 11, i.e., retains the bed frame components in a unitary or locked up frame configuration.

Having described in detail the preferred embodiment of my invention, what I desire to claim and protect by Letters Patent is:

1. A method of assembling a bed frame of the type having headboard and footboard members, and opposed left and right side rails, said method comprising the steps of connecting a first rod adjacent the footboard end of said left side rail and the headboard end of said right side rail, connecting a second rod adjacent the footboard end of said right side rail and the headboard end of said left side rail, connecting said right side rail to the right side of said footboard member at one end and to the right side of said headboard member at the other end, connecting one end of said left side rail to the left side of one of said headboard member and said footboard member, thereafter drawing said left side rail into generally parallel alignment with said right side rail while simultaneously placing both said first and second rods in tension, and thereafter connecting the other end of said left side rail to the left side of the other of said headboard member and said footboard member, connection thereof maintaining both said first and second rods in tension, said bed frame being thereafter locked up into a tight frame configuration due to the maintenance of tension in both said first and second rods after connection of both said side rails with said headboard and footboard members.

2. A method as set forth in claim 1, including the steps of providing at least two connection points in one of said side rails for connecting one end of one of said rods therewith, and selecting that one of said connection points which insures that said rods will be placed in tension upon erection of said bed frame.

3. A method as set forth in claim 2, one of said connection points being adapted for use when said bed frame is of a single bed width and the other of said connection points being adapted for use when said bed frame is of a double bed width.

4. A method of assembling a bed frame of the type having headboard and footboard members, and opposed left and right side rails, said method comprising the steps of connecting a first tension rod adjacent the footboard end of said left side rail and the headboard end of said right side rail, connecting a second tension rod adjacent the footboard end of said right side rail and the headboard end of said left side rail, the distance between said side rails at one end thereof being less than the bed width of that one of said headboard and footboard to which those ends of said side rails are to be connected, and the distance between said side rails at the other end thereof being no greater than the bed width of that other of said headboard and footboard to which those other ends of said side rails are to be connected, connecting said right side rail to one footboard leg at one end and to one headboard leg at the other end, connecting one end of said left side rail to one of the other headboard leg and the other footboard leg, and thereafter drawing said left side rail into generally parallel alignment with said right side rail to permit connecting the other end of said left side rail to the other of the other headboard leg and the other footboard leg, connection thereof placing both said tension rods in tension, thereby erecting and locking up the bed frame into a tight frame configuration.

5. A method as set forth in claim 4 including the steps of providing at least two connection points in one of said side rails for connecting one end of one of said tension rods therewith, and selecting that one of said connection points which insures that said tension rods will be placed in tension upon erection of said bed frame.

6. A method as set forth in claim 5, one of said connection points being adapted for use when said bed frame is of a single bed width and the other of said connection points being adapted for use when said bed frame is of a double bed width.

7. An improved bed frame structure comprising a headboard member and a footboard member, a left side rail connecting said headboard and footboard members on the left side of said bed frame, and a right side rail connecting said headboard and footboard members on the right side of said bed frame, and a first rod connecting said left side rail adjacent the footboard end thereof and said right side rail adjacent the headboard end thereof, and a second rod connecting said right side rail adjacent the footboard end thereof and said left side rail adjacent the headboard end thereof, the length of said rods in combination with the rods' connection points on said side rails requiring that, during assembly, said right side rail be connected to the right side of said footboard at one end and to the right side of said headboard at the other end, said left side rail be connected at one end to the left side of one of said headboard and said footboard, the other end of said left side rail be thereafter drawn into generally parallel alignment with said right side rail for placing both said first and second rods in tension, and the other end of said left side rail be thereafter connected to the left side of the other of said headboard and said footboard for maintaining both said first and second rods in tension when said bed frame is fully erected, said bed frame being locked into a tight frame configuration due to the maintenance of tension in both said first and second rods after connection of both side rails with said headboard and footboard members.

8. An improved bed frame as set forth in claim 7, one end of at least one of said tension rods being connectable with one of said side rails in one of two connection point positions, said tension rod being so connected with said side rail in a first position when said bed width is of a first width, and said tension rod being so connected with said side rail in a second position when said bed width is of a second width, for permitting said side rails and tension rods to be used with two different headboard and footboard pairs, said pairs differing one from the other in bed width.

9. An improved bed frame as set forth in claim 8 wherein one bed width is a single bed width, and the other bed width is a double bed width.

10. An improved bed frame as set forth in claim 8, said bed frame including at least two groups of connection points defined on at least one side rail for connecting one end of one tension rod to that side rail, at least one of said groups comprising at least two connection points, that connection point with which that one end of said one tension rod is connected being dependent on the bed width of that headboard and footboard pair with which said side rails and tension rods is used.

11. An improved bed frame as set forth in claim 10, each of said two groups comprising at least two connection points, said first group being used when said bed frame is generally of a single bed width and said second group being used when said bed frame is generally of a double bed width.

* * * * *